US010249460B2

(12) United States Patent
Zhao et al.

(10) Patent No.: US 10,249,460 B2
(45) Date of Patent: Apr. 2, 2019

(54) HIGH THERMAL STABILITY THERMAL CUTOFF DEVICE PELLET COMPOSITION

(71) Applicant: THERM-O-DISC, INCORPORATED, Mansfield, OH (US)

(72) Inventors: Changcai Zhao, Zhuhai (CN); Shi Wei, Zhuhai (CN)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 15/506,183

(22) PCT Filed: Sep. 1, 2014

(86) PCT No.: PCT/CN2014/085667
§ 371 (c)(1),
(2) Date: Feb. 23, 2017

(87) PCT Pub. No.: WO2016/033722
PCT Pub. Date: Mar. 10, 2016

(65) Prior Publication Data

US 2017/0278657 A1 Sep. 28, 2017

(51) Int. Cl.
*H01B 1/12* (2006.01)
*H01H 37/32* (2006.01)
*H01H 37/76* (2006.01)

(52) U.S. Cl.
CPC ..... *H01H 37/32* (2013.01); *H01B 1/12* (2013.01); *H01H 37/76* (2013.01); *H01H 2037/769* (2013.01)

(58) Field of Classification Search
CPC .... H01B 1/12; H01H 2037/769; H01H 37/32; H01H 37/76
See application file for complete search history.

(56) References Cited

U.S. PATENT DOCUMENTS 4,065,741 A 12/1977 Sakamoto et al.
4,514,718 A 4/1985 Birx
(Continued)

FOREIGN PATENT DOCUMENTS

CN 103515041 A 1/2014
CN 106796855 A 5/2017
(Continued)

OTHER PUBLICATIONS

Chemical Abstracts Registry No. 2222-33-5 (Year: 1984).*
(Continued)

*Primary Examiner* — Mark Kopec
*Assistant Examiner* — Jaison P Thomas
(74) *Attorney, Agent, or Firm* — Harness, Dickey & Pierce, P.L.C.

(57) ABSTRACT

Provided is a pellet composition having enhanced thermal stability for use in a thermally-actuated, current cutoff device. The solid thermal pellet composition comprises an organic compound have low ionization potential, such as dibenzosuberenone. The solid pellet maintains its structural rigidity up to a transition temperature ($T_f$), but further has improved overshoot temperature ranges. Therefore, the improved thermal pellets have a maximum dielectric capability temperature ($T_{cap}$), above which the pellet composition may lose substantial dielectric properties and conducts current that is at least 160° C. greater than the $T_f$. The aging performance is further enhanced. Further, methods of enhanced processing and pelletizing are provided.

19 Claims, 2 Drawing Sheets

(56) References Cited

U.S. PATENT DOCUMENTS

| | | | | |
|---|---|---|---|---|
| 6,673,257 | B1 | 1/2004 | Hudson | |
| 8,961,832 | B2 | 2/2015 | Kent et al. | |
| 2006/0192777 | A1* | 8/2006 | Matsubara | H04N 13/049 345/419 |
| 2011/0272030 | A1* | 11/2011 | Kitazawa | C08G 61/122 136/263 |
| 2013/0112965 | A1* | 5/2013 | Sekiguchi | C07C 49/675 257/40 |
| 2013/0334471 | A1* | 12/2013 | Hinrichs | H01H 37/764 252/519.3 |

FOREIGN PATENT DOCUMENTS

| | | | | |
|---|---|---|---|---|
| EP | 2151846 | A2 | 2/2010 | |
| EP | 2674956 | A1 | 12/2013 | |
| WO | WO-9928284 | A1 * | 6/1999 | C07C 49/697 |

OTHER PUBLICATIONS

International Search Report and Written Opinion of the ISA for PCT/CN2014/085667, ISA/CN, Beijing, dated May 27, 2015.

First Office Action for corresponding Chinese Application No. 201480081629.1 dated Jun. 19, 2018 and correspondence dated Jul. 3, 2018 from Unitalen Attorneys at Law summarizing contents.

Parakka, James P. et al., "Molecular-based chiroptical dipole switches," Proc. SPIE 4416, Optical Engineering for Sensing and Nanotechnology (ICOSN 2001), (May 8, 2001); doi: 10.1117/12.427073.

* cited by examiner

HIGH THERMAL STABILITY THERMAL CUTOFF DEVICE PELLET COMPOSITION

CROSS REFERENCE TO RELATED APPLICATIONS

This application is a U.S. National Phase Application under 35 U.S.C. 371 of International Application No. PCT/CN2014/085667, filed on Sep. 1, 2014 and published in English as WO 2016/033722 A1 on Mar. 10, 2016. The entire disclosure of the above application is incorporated herein by reference.

FIELD OF THE INVENTION

The present disclosure relates to material compositions for use as pellets in electrical current interruption devices and more particularly to improved pellet compositions and materials for enhanced thermally stability in electrical current interruption safety devices, or thermal cut-offs.

BACKGROUND OF THE INVENTION

This section provides background information related to the present disclosure which is not necessarily prior art.

Temperatures of operation for appliances, electronics, motors and other electrical devices typically have an optimum range. The temperature range where damage can occur to system components or where the device becomes a potential safety hazard is an important detection threshold. Various safety devices are capable of sensing such over-temperature thresholds. Certain safety devices are capable of sensing over-temperature conditions and interrupting electrical current, including electrical thermal fuses, which only operate in a narrow temperature range. For example, tin and lead alloys, indium and tin alloys, or other metal alloys that form a eutectic metal, are unsuitable for appliance, electronic, electrical and motor applications due to undesirably broad temperature response thresholds and/or detection temperatures that are outside the desired range of safety.

One type of device particularly suitable for over-temperature detection is an electrical current interruption safety device, known as a thermal cut-off device (TCO), which is capable of temperature detection and simultaneous interruption of current, when necessary. Such TCO devices are typically installed in an electrical application between the current source and electrical components, such that the TCO is capable of interrupting the circuit continuity in the event of a potentially harmful or dangerous over-temperature condition. TCOs are often designed to shut off the flow of electric current to the application in an irreversible manner, without the option of resetting the TCO current interrupting device. Certain appliances and applications require the use of robust over-temperature detection devices with high-holding temperatures exceeding the operating temperatures and/or holding temperatures of conventional TCO designs. Thus, in various aspects, the present disclosure provides TCO designs that are thermally stable and continue to exhibit dielectric properties after activation or current interruption, even at high temperatures.

SUMMARY OF THE INVENTION

This section provides a general summary of the disclosure, and is not a comprehensive disclosure of its full scope or all of its features.

In certain aspects, the present disclosure provides a pellet composition for use in a thermally actuated, current cutoff device. The pellet composition comprises an organic component with a low ionization potential. In certain variations, the pellet composition comprises dibenzosuberenone. Such a pellet composition is in a solid phase and maintains its structural rigidity up to a transition temperature ($T_f$). In certain variations, the transition temperature ($T_f$) may be greater than or equal to about 80° C. The pellet composition also has a maximum dielectric capability temperature ($T_{cap}$), above which the pellet composition may lose substantial dielectric properties. In accordance with certain aspects of the present disclosure, $T_{cap}$ for the inventive pellet compositions is at least about 300° C.

In other aspects, the present teachings provide a thermal cutoff device that comprises a thermal pellet disposed in a housing. The thermal pellet composition comprises an organic component with a low ionization potential. In certain variations, the thermal pellet comprises dibenzosuberenone. Such a thermal pellet composition is in a solid phase and maintains its structural rigidity up to a transition temperature ($T_f$). In certain variations, the transition temperature ($T_f$) may be greater than or equal to about 80° C. The thermal pellet also has a maximum dielectric capability temperature ($T_{cap}$), above which the thermal pellet may lose substantial dielectric properties. In accordance with certain aspects of the present disclosure, $T_{cap}$ for the thermal pellet is at least about 300° C. A seal is disposed in a portion of at least one opening of the housing to substantially seal the housing up to the transition temperature. The thermal cutoff device further includes a current interruption assembly at least partially disposed within the housing that establishes electrical continuity in a first operating condition corresponding to an operating temperature of less than the transition temperature of the thermal pellet, and that discontinues electrical continuity when the operating temperature exceeds the transition temperature.

In yet other aspects, the present disclosure also provides methods for making a thermal pellet composition having enhanced thermal stability for use in a thermally actuated, current cutoff device. The method may comprise admixing dibenzosuberenone and one or more additive components selected from the group consisting of: binders, lubricants, press-aids, pigments, and combinations thereof to form an admixture. The admixture is melted and then cooled. The admixture is ground to form a powder. Then, the powder is disposed in a die and pressure is applied to the powder to form a solid pellet.

Further areas of applicability will become apparent from the description provided herein. The description and specific examples in this summary are intended for purposes of illustration only and are not intended to limit the scope of the present disclosure.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE INVENTION

Figure 1:
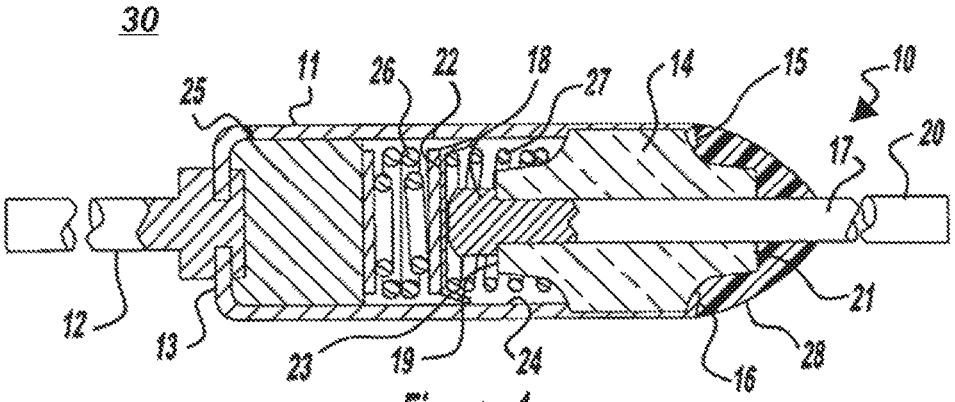
FIG. 1 is an enlarged cross sectional view of an exemplary conventional thermal cutoff device construction.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range, including endpoints given for the ranges.

Example embodiments will now be described more fully with reference to the accompanying drawings. Various safety electrical current interruption devices, including thermal cut-off electrical current interruption safety devices ("TCOs") are used as safety devices in a broad range of application temperatures. The TCOs are incorporated into an electrical device, such an appliance, motor, or consumer device, and serve as a safety device by breaking or interrupting electrical current above a threshold temperature or temperature rating, typically ranging from about 60° C. up to about 235° C. In the accompanying discussion, the term "TCO" encompasses both conventional TCO devices and their high-temperature counterparts (HTTCOs). The present teachings pertain to improved pellet compositions for thermal cut-off devices having greater thermal stability and robustness, particularly at overshoot temperatures above which the materials actuate the TCO device.

Figure 2:
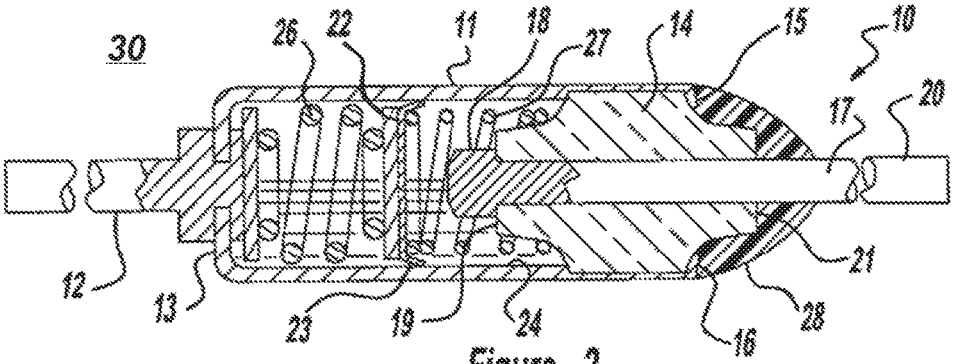
FIG. 2 illustrates the thermal cutoff device construction of FIG. 1 after a thermal pellet has undergone a physical transition and a current interruption actuating assembly has caused electrical switching to break continuity and change the thermal cutoff device's operating condition.

By way of background, an exemplary conventional TCO device is described herein, as set forth in FIGS. 1 and 2. In general, a conventional TCO 10 includes a conductive metallic housing or casing 11 having a first metallic electrical conductor 12 in electrical contact with a closed end 13 of the housing 11. An isolation bushing 14, such as a ceramic bushing, is disposed in an opening 15 of the housing 11. Housing 11 further includes a retainer edge 16, which secures the ceramic bushing 14 within the end of the housing 11. An electric current interrupter assembly for actuating the device in response to a high temperature, for example, by breaking continuity of an electrical circuit, includes an electric contact 17, such as a metallic electrical conductor, at least partially disposed within the housing 11 through opening 15. Electric contact 17 passes through isolation bushing 14 and has an enlarged terminal end 18 disposed against one side 19 of isolation bushing 14 and a second end 20 projecting out of the outer end 21 of isolation bushing 14.

A seal 28 is disposed over the opening 15 and can create sealing contact with the housing 11 and its retainer edge 16, the isolation bushing 14, and the exposed portion of the second end 20 of electric contact 17. In this manner, an interior portion 29 of the housing 11 is substantially sealed from the external environment 30. By "substantially sealed" it is meant that while the barrier seal is optionally porous at a microscopic level, the barrier is capable of preventing escape or significant mass loss of the thermal pellet material, for example, the seal retains at least about 98-99% of the mass of the initial thermal pellet through 1,000 hours of continuous operation at a predetermined temperature within the housing, in certain variations.

Figure 4:
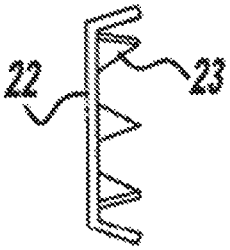
FIG. 4 is a side view of a sliding contact member of the current interruption actuating assembly switch construction of FIG. 1.

The current interruption assembly, which actuates or switches to change continuity of an electrical circuit, further includes a sliding contact member 22, formed of electrically conductive material, such as a metal is disposed inside the housing 11 and has resilient peripheral fingers 23 (FIG. 4) disposed in sliding engagement with the internal peripheral surface 24 of the housing 11 to provide electrical contact there between. Moreover, when the TCO has an operating temperature that is below the predetermined threshold or set-point temperature of the TCO device, the sliding contact member 22 is disposed in electrical contact with the terminal end 18 of electric contact 17.

Current interruption assembly also includes a compression mechanism, which may include a plurality of distinct compression mechanisms. The compression mechanism biases the sliding contact member 22 against the terminal end 18 of electric contact 17 to establish electrical contact in the first operating condition (where operating temperatures are below the threshold temperature of the TCO device, as will be described below). As shown in FIGS. 1 and 2, the compression mechanism includes a pair of springs, which are respectively disposed on opposite sides of the sliding contact member 22. The springs include a relatively strong compression spring 26 and a relatively weak compression trip spring 27.

Figure 3:
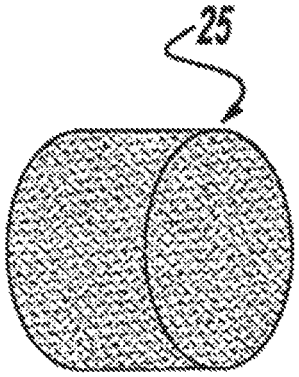
FIG. 3 is a side perspective view illustrating a thermally stable pellet according to certain aspects of the present disclosure.

A thermally responsive pellet or thermal pellet 25, as best illustrated in FIG. 3, is disposed in the housing 11 against the end wall 13 thereof. The compression spring 26 is in a compressed state between the solid thermal pellet 25 and the sliding contact member 22 and in the exemplary design shown, generally has a stronger compressed force than the force of the compressed trip spring 27, which is disposed between the contact member 22 and the isolation bushing 14, such that the sliding contact member 22 is biased towards (e.g., held by the force of the spring 26) and in electrical contact with the enlarged end 18 of the electrical contact 17. In this manner, an electrical circuit is established between the first electrical conductor 12 and electrical contact 17 through the conductive housing 11 and sliding contact member 22.

As noted above, the TCO device is designed to include a thermal pellet 25 that comprises a pellet composition in a solid phase that is reliably stable in the first operating condition (where the operating temperature, for example, the temperature of the surrounding environment 30, is below a threshold temperature); however reliably transitions to a different physical state when the operating temperature meets or exceeds such a threshold temperature in a second operating condition. Thus, the pellet composition that forms thermal pellet 25 is in a solid phase and maintains its structural rigidity up to a threshold or final temperature ($T_f$) (also referred to as a transition, actuation, or threshold temperature), at which point internal contact breaks continuity due to structural changes in the pellet material composition, which in turn causes relaxing or opening of compression mechanisms, for example. When the operating temperature meets or exceeds the transition temperature $T_f$, the thermal pellet 25 melts, liquefies, softens, volatilizes, sublimates, or otherwise transitions to a different physical state to transform from a solid having structural rigidity to a form or phase that loses structural rigidity, either by contraction, displacement, or other physical changes, during an adverse heating condition, which is illustrated in FIG. 2. When the surrounding environment reaches the transition or final temperature ($T_f$), and the pellet loses structural rigidity, it causes the internal electrical contacts to separate due to the applied force from the expanding trip spring 27. In certain alternative device configurations, the device may remain electrically closed after activation as appreciated by those of skill in the art and such variations are likewise contemplated by the present teachings.

However, after a pellet composition reaches and then exceeds the transition temperature ($T_f$) and breaks electrical continuity, to serve as an efficacious safety device, the material composition should be thermally stable and continue to exhibit dielectric properties for temperature ranges well in excess of the transition temperature ($T_f$). This is sometimes referred to as a thermal overshoot temperature range. Thus, a thermal pellet composition also has a maximum dielectric capability temperature ($T_{cap}$), above which the pellet can lose its dielectric and/or insulation resistance properties and/or begins to conduct electrical current in a typical TCO device. The $T_{cap}$ is related to a maximum temperature rating ($T_{max}$) of the thermal pellet composition. A $T_{max}$ is a rated temperature at which 100% of the TCO devices tested (incorporating the pellet composition) will continue to remain electrically opened after activation, actuation, or tripping to continue to provide safety benefits in the device (in a temperature range above the $T_f$) at specified test conditions discussed below. The $T_{max}$ is typically selected to be below the $T_{cap}$ as a margin of safety for use in a given application.

Figure 5:
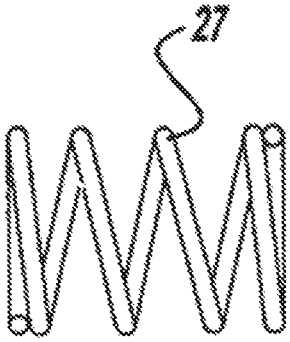
FIG. 5 is a side view of one of the springs of the current interruption actuating assembly of FIG. 1.

The springs 26 and 27 thus are adapted to expand and relax, as illustrated by expanded trip spring 27 in FIG. 5, and through the relationship of the particular forces and length of the compression spring 26 and compression trip spring 27, the sliding contact member 22 is moved out of electrical contact with the end 18 of the electric contact 17 in the manner shown in FIG. 2, so that the electrical circuit between the terminal conductor 12 and electrical contact 17 through the thermal cutoff construction 10 (via the housing 11 and sliding contact member 22) is discontinued and broken, remaining open as illustrated in FIG. 2. The thermal cutoff device described in the present disclosure is used for purposes of illustration is exemplary and therefore should not be construed to necessarily be limiting. In certain aspects, various components, designs, or operating principles may be varied in number or design. Various other thermal switching or cutoff devices are known in the art and likewise contemplated by the present disclosure.

As described above, in various aspects, pellet material compositions are designed to have a transition temperature that permits the TCO device to have a final temperature ($T_f$) (also referred to as transition, actuation, or threshold temperature), where activation within the device can break internal contacts due to structural changes in the pellet material composition. Thus, the pellet composition is in a solid phase and maintains its structural rigidity up to a transition or final temperature ($T_f$), at which point, a switch in continuity is activated due to structural transitioning or breakdown of the solid thermal pellet. Once the pellet material composition reaches its transition temperature ($T_f$), it means that the material no longer possesses the structural integrity required to maintain a compression mechanism, such as a switch in a held-closed position, depending on the TCO device, for example. This transition temperature ($T_f$) can also be referred to as a "melting-point" and provides the TCO device rating; however, the compounds in the pellet composition need not fully melt in a conventional sense to achieve separation of the electrical contacts to break the internal circuit and electrical continuity.

Various pellet chemicals can degrade at higher temperatures and can transition from having desirably high dielectric and insulating properties to being partially or fully electrically conductive. Thus, if the thermal pellet melts or physically softens after reaching and exceeding the transition temperature ($T_f$), but the temperature of the surrounding environment continues to rise to a point that the thermal pellet composition becomes electrically conductive, it is possible for the thermal pellet composition to re-establish electrical conductivity in the TCO safety device, and cause undesired overheating or hazardous conditions, and thus poses a potential safety concern.

Hence, as discussed above, $T_{cap}$ is generally understood to be a maximum overshoot temperature range above the transition temperature $T_f$ at which the TCO will remain electrically open. A maximum dielectric capability temperature ($T_{cap}$) is related to the $T_{max}$, but $T_{cap}$ may often significantly exceed the $T_{max}$ rated temperature. $T_{cap}$ is indicative of the pellet composition's high temperature stability, but as appreciated by those of skill in the art, may not correspond to rigorous industry-based testing standards for a $T_{max}$ rating exhibiting 100% passage of tested devices incorporating pellet compositions of interest. Further, while $T_{cap}$ may be assessed by the same test procedures and protocols as the $T_{max}$ rating tests, $T_{cap}$ may also be tested by alternative test procedures that are indicative of high temperature stability, for example, at differing voltage rates or temperatures than standard test conditions and protocols for $T_{max}$ rating like those described below. Usually, in the interest of safety, a margin of at least about 20° C.-30° C. is subtracted from $T_{cap}$ to arrive at a maximum temperature rating ($T_{max}$) to provide a rating for a given thermal pellet composition used in a TCO device. Thus, the $T_{cap}$ encompasses and in certain aspects, exceeds a rated $T_{max}$ for a given thermal pellet composition.

In various aspects, the pellet material compositions of the present teachings are thermally and chemically stable, reliable and robust for use in the thermal cutoff device application. Thus, after transitioning to the different physical state in the second operating condition, the pellet composition is exposed to operating temperatures in excess of threshold temperature in a third operating condition up to a maximum dielectric capability temperature ($T_{cap}$), up to which it is desirably stable and retains dielectric and insulative properties to prevent conduction of current therethrough. Hence, in certain aspects, the present teachings are directed to improving thermal stability and broadening overshoot temperatures (e.g., maximum dielectric capability temperature ($T_{cap}$) and/or a maximum temperature rating ($T_{max}$) ratings) for certain thermal pellet compositions having a wide range of transition temperatures ($T_f$) for use in thermal cutoff devices.

Certain thermal pellet compositions in particular suffer from thermal instability at relatively low overshoot temperatures above $T_f$. For example, the present teachings are particularly suitable to replace pellet compositions having a maximum rated temperature $T_{max}$ and/or an initial maximum dielectric capability temperature ($T_{capinitial}$) (where the initial pellet composition may lose substantial dielectric properties and conducts current) at a temperature that is above the $T_f$, but falls within a range that is 160° C. or less above $T_f$ (so that $T_f < T_{capinitial} \leq (T_f + 160°\ C.)$ and/or $T_f < T_{max} \leq (T_f + 160°\ C.)$). As noted above, a thermal pellet $T_{cap}$ typically encompasses and exceeds $T_{max}$. Further, use of the terms $T_{capinitial}$ and $T_{capimproved}$ are used for nominative purposes and are used interchangeably with the generic term $T_{cap}$. In various aspects, the pellet compositions have an initial maximum dielectric capability temperature ($T_{capinitial}$) that exceeds the transition temperature $T_f$.

In accordance with certain aspects of the present teachings, methods are provided for enhancing thermal stability of a pellet composition for use in a thermally actuated, current cutoff device. In various aspects, the present disclosure provides a thermal pellet material composition that comprises one or more organic compounds that determine the thermal pellet material composition's transition temperature ($T_f$) up to which the pellet composition is in a solid phase and maintains its structural rigidity. The pellet composition according to certain aspects of the present disclosure comprises an organic component with a low ionization potential. For example, in certain variations, a range of ionization potential for an organic compound that provide thermal stability is optionally greater than or equal to about 0.1 mg/kg to less than or equal to about 1 mg/kg, when ionization levels are measured via an ion chromatography tester, by way of example. In accordance with certain aspects of the inventive technology, a new organic compound has been unexpectedly discovered to improve thermal stability, improve processing and production yield, and improve pellet strength and aging performance, while $T_f$ of the solid thermal pellet remains nearly the same. In certain aspects, the pellet composition comprises a polycyclic hydrocarbon, such as a substituted arene. In certain preferred aspects, the inventive thermal pellet composition comprises dibenzosuberenone (5H-dibenzo[a,d][7]annulen-5-one, CAS Registry No. 2222-33-5) represented by formula I.

(I)

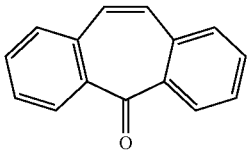

As compared to a conventional thermal cutoff pellet composition (e.g., comprising p-dibromobenze), the inventive thermal cutoff pellet composition comprising dibenzosuberenone significantly increases the maximum dielectric capability temperature ($T_{cap}$) for the thermal pellet composition. The inventive thermal cutoff pellet composition comprising dibenzosuberenone unexpectedly improves the temperature stability of the thermal pellet material composition above, as well as improving temperature stability at temperatures below the transition temperature $T_f$, among other advantages.

As discussed further below, the dibenzosuberenone has a relatively low ionization energy or ionization potential, as compared to conventional organic compounds used in conventional thermal cutoff pellets (e.g., p-dibromobenzene). Often conventional organic chemicals have acidic structures, such as structures with multiple hydroxies or structures that might have ionic activity in an electrical field, such as sulfur side groups or bonds, which easily break down in the presence of an electrical field and high temperatures The pellet composition comprising dibenzosuberenone or similar arenes lacks an ionizable group and thus is far more stable at high temperatures and capable of maintaining greater thermal stability.

Improved thermal stability above the transition temperature may be reflected by one or more of the following non-limiting benefits: (i) increasing a maximum dielectric capability temperature ($T_{cap}$), above which the pellet can lose its dielectric and/or insulation resistance properties and/or begins to conduct electrical current in a conventional TCO device; (ii) increasing a maximum temperature ($T_{max}$) rating for a pellet composition; (iii) increasing breakdown voltages for the open TCO device at a predetermined temperature, as well as improving pellet stability below the transition temperature ($T_f$) (iv) improving aging performance.

The pellet material compositions may comprise an organic compound, such as dibenzosuberenone, which is selected to meet one or more of the following criterion. In certain aspects, an organic compound or compounds selected for use in the thermal pellet has a relatively high chemical purity. For example, in certain embodiments, chemicals used for the high temperature thermal pellet compositions have a range of purity levels from greater than or equal to about 95% up to greater than about 99%. In certain aspects, the organic compositions and any additives selected for use in the thermal pellet compositions are particularly suitable for processing, handling, and toxicity characteristics. In certain embodiments, the organic chemical compounds or compositions selected for use in the pellet compositions have a median lethal dose toxicity value (LD50) less than or equal to about 220 mg/kg (ppm) for a mouse; less than or equal to about 400 mg/kg (ppm) for a rabbit; and less than or equal to about 350 mg/kg (ppm) for a rat. Further, in certain aspects, the selected organic chemical compound and any additive compositions for the component compound desirably do not have documented carcinogenicity effects, mutagenicity effects, neurotoxicity effects, reproductive effects, teratogenicity effects, and/or other harmful health or epidemiological effects. In yet other aspects, the at least one organic compound and at least one inorganic stability additive particle for the pellet material compositions are selected such that alternate reactive residuals, reaction products formed during manufacture, decomposition products, or other species that might be formed during manufacture, storage, or use are absent, minimized, or are capable of purification and removal of such undesired species.

In various aspects, the TCO pellet composition material comprises one or more organic compounds, including dibenzosuberenone, cumulatively present at greater than or equal to about 90% by weight of the total pellet composition. For example, in certain embodiments, the one or more organic compounds can be a single organic compound, dibenzosuberenone, that is present at greater than or equal to about 90% by weight, optionally greater than or equal to about 93% by weight, optionally greater than or equal to about 94% by weight, optionally greater than or equal to about 95% by weight, optionally greater than or equal to about 96% by weight, optionally greater than or equal to about 97% by weight, optionally greater than or equal to about 98% by weight, optionally greater than or equal to about 98.5% by weight, optionally greater than or equal to about 99% by weight, optionally greater than or equal to about 99.1% by weight, and in certain aspects, greater than or equal to about 99.2% by weight organic compounds in the total pellet material composition. In certain aspects, the organic compound(s) or chemical(s), including dibenzosuberenone, are processed to minimize evaporative loss, enhance crystallinity, and to obtain high purity levels.

The dibenzosuberenone can be mixed with various additive ingredients to form a mixture. Therefore, in addition to the one or more organic compounds, including dibenzosuberenone, the thermal pellet composition optionally comprises one or more conventional pellet composition components selected from the group consisting of: binders, lubricants, and press-aids, release agents, pigments, and combinations thereof, by way of example. These additives can be mixed with the organic compound(s), including dibenzosuberenone. In certain aspects, the one or more components are cumulatively present at less than or equal to about 10% by weight of the total pellet composition, optionally less than or equal to about 7% by weight of the total pellet composition optionally less than or equal to about 5% by weight of the total pellet composition and in certain aspects, optionally less than or equal to about 3% by weight of the total pellet composition. The balance of the thermal pellet composition may thus comprise the dibenzosuberenone organic compound.

A binder component, which generally softens (melts) at a temperature below the melting point of the organic component, is primarily utilized to assist in the production of pellets. While various binders known for pellet formation can be utilized, suitable binders include Dow Chemical D.E.R. 663U Epoxy Powder, polyethylene glycol, 1,3-benzenediol, epoxies, polyamides and combinations thereof, by way of non-limiting example. The binder is generally present in amounts of less than or equal to about 10% by weight based on the total composition, optionally at greater than or equal to about 1% by weight to less than or equal to about 5% by weight of the total composition.

Additionally, it may be desirable to employ a lubricant, release agent, or pressing aid to contribute to flowing and fill properties (into a die) when processing the thermal pellets. For example, among the numerous lubricants or press aids that have proven useful are calcium stearate, boron nitride, magnesium silicate and polytetrafluoroethylene (Teflon®), among others. The lubricant is generally present in an amount up to about 5% by weight based on the total pellet composition. In certain aspects, the present pellet compositions comprising dibenzosuberenone minimize or avoid the need to include lubricants, due to enhanced flow and processing properties. Thus, in certain variations, the pellet composition is substantially free or entirely free of any lubricants or press-aids.

It may also be desirable in certain variations to incorporate coloring agents, such as pigments, into the pellet composition to allow for rapid visual inspection of pellet condition. Various well-known pigments are compatible with the aforementioned thermal cutoff composition components and temperatures at which they operate may be employed. Pigments, when employed, are typically present in an amount up to about 2% by weight of the total pellet composition.

In certain embodiments, the pellet composition may consist essentially or solely of the dibenzosuberenone and one or more additive components selected from the group consisting of: binders, lubricants, press-aids, pigments, and combinations thereof. In certain other embodiments, the pellet composition may consist essentially or solely of the dibenzosuberenone and one or more additive components selected from the group consisting of: binders, pigments, and combinations thereof.

Thus, the pellet composition may consist essentially of a single organic composition, dibenzosuberenone (as the primary ingredient to arrive at a predetermined, desired transition temperature $T_f$ and the improved maximum dielectric capability temperature $T_{cap}$ and/or improved maximum rated temperature $T_{max}$, or enhanced rate of aging), and optionally one or more components selected from the group consisting of: a binder, a press aid, a release agent, a pigment, or other conventional TCO pellet composition additives or diluents that do not impact the functional properties of the pellet. Such a pellet composition may comprise minimal amount of diluents or impurities that do not substantially affect the transition temperature of the pellet composition or the performance of the TCO at operating temperatures above the threshold temperature.

In other aspects, a stable thermal pellet material composition thus comprises one or more organic compounds, including dibenzosuberenone and is desirably capable of exhibiting substantial dielectric properties at least about 160° C. degrees above its transition temperature $T_f$ in a TCO. By use of the term "substantial dielectric properties," it is meant that the pellet composition is capable of maintaining a 500 volt (twice a rated voltage of about 240-250 volts) 60 Hz sinusoidal AC potential between two electrodes for at least one minute without conducting greater than 250 mA or in alternative aspects, may be measured as having a minimum insulation resistance across open electrodes of at least about 0.2 MΩ at two times a rated voltage DC (where a rated voltage is about 250 volts AC). In certain aspects, such a test may be conducted at other voltage and test conditions. The temperature above which a pellet material composition may or can no longer exhibit such substantial dielectric properties is known as the maximum dielectric capability temperature ($T_{cap}$), as previously discussed above.

In other variations, a pellet material composition for use in a TCO according to certain aspects of the present teachings comprises dibenzosuberenone and thus exhibits substantial dielectric properties and has a maximum dielectric capability temperature ($T_{cap}$) of greater than or equal to about 170° C., optionally greater than or equal to about 180° C., optionally greater than or equal to about 190° C., optionally greater than or equal to about 200° C., optionally greater than or equal to about 210° C., optionally greater than or equal to about 220° C., optionally greater than or equal to about 230° C., optionally greater than or equal to about 240° C., optionally greater than or equal to about 250° C., optionally greater than or equal to about 260° C. optionally greater than or equal to about 270° C. optionally greater than or equal to about 280° C., optionally greater than or equal to about 290° C., optionally greater than or equal to about 300° C., optionally greater than or equal to about 310° C., optionally greater than or equal to about 320° C., optionally greater than or equal to about 330° C., and optionally greater than or equal to about 340° C. In certain embodiments, a pellet material composition for use in a TCO comprises dibenzosuberenone and has a maximum dielectric capability temperature ($T_{cap}$) that is greater than or equal to about 200° C. and less than or equal to about 400° C.

Therefore, in preferred variations, the thermally enhanced pellet material composition will include one or more organic compounds, including dibenzosuberenone, having a maximum dielectric capability temperature ($T_{cap}$) of the pellet composition to at least 50° C. above the final temperature ($T_f$) (also referred to as actuation or transition temperature), where the internal contact breaks continuity in a thermal cutoff device due to structural changes in the pellet material composition, which in turn causes relaxation of compression mechanisms in a thermal cutoff device, for example. In certain variations, the pellet composition material exhibits a maximum dielectric capability temperature ($T_{cap}$) optionally greater than or equal to about 160° C., optionally greater than or equal to about 170° C., optionally greater than or equal to about 180° C., optionally greater than or equal to about 190° C. optionally greater than or equal to about 200° C., optionally greater than or equal to about 210° C., optionally greater than or equal to about 220° C., optionally greater than or equal to about 230° C., optionally greater than or equal to about 240° C., optionally greater than or equal to about 250° C., optionally greater than or equal to about 260° C., optionally greater than or equal to about 270° C., optionally greater than or equal to about 280° C. optionally greater than or equal to about 290° C., optionally greater than or equal to about 300° C., optionally greater than or equal to about 310° C., optionally greater than or equal to about 320° C., optionally greater than or equal to about 330° C. above the transition temperature $T_f$ of the pellet material composition, and in certain aspects, the pellet material composition exhibits substantial dielectric properties at least about 340° C. above a threshold transition temperature $T_f$ of the pellet material composition.

In various aspects, the thermal cutoff devices of the present disclosure comprises a sealed housing having disposed therein a pellet material composition having an average transition temperature $T_f$ or melting point of greater than or equal to about 70° C., optionally greater than or equal to about 75° C. optionally greater than or equal to about 80° C., optionally greater than or equal to about 85° C., optionally greater than or equal to about 86° C., optionally greater than or equal to about 87° C., optionally greater than or equal to about 88° C., and in certain aspects, greater than or equal to about 89° C.

This transition temperature $T_f$ can also be referred to as a "melting-point"; however, the compounds in the pellet composition need not fully melt in a conventional sense to achieve separation of the electrical contacts to break the internal circuit and electrical continuity. As recognized by those of skill in the art, a melting-point temperature is one where compounds or compositions transform from solid to liquid phase, which may occur at a range of temperatures, rather than at a single discrete temperature point. In certain aspects, the high temperature thermal pellet may soften or sublimate rather than melting, by way of non-limiting example, to achieve the separation of electrical contacts to break the circuit. Melting-point temperatures can be measured in various apparatuses, such as those produced by Thomas Hoover, Mettler and Fisher-Johns companies. Differential Scanning Calorimetry (DSC) techniques are also commonly used. Different measurement techniques may result in differing melting points, for example, optical analysis methods like Fisher-Johns measure light transmittance through a sample, a solid to liquid phase change. Early optical methods potentially suffered greater observer error versus more modern light beam transmittance melt point indicators. In addition, earlier techniques to determine melting point (before the use of digital high-speed scan capabilities), rendered a broader range of results for melt points and other transitions. Likewise, before the advent of HPLC and other precise analytical techniques for determination of purity, the melt point of a sample, for example, measured by DSC, which measures heat flow behavior for example, crystallinity (solid-solid phase) changes as well as, solid to liquid phase changes, could show the solid-solid phase change of an impurity that may have been reported as a melt point, such as dehydration or breaking of hydroxyl bonds, as well as the solid-liquid phase change at the melt point for the material of interest. Thus, in various aspects, a composition can be selected for use in the thermal pellet that empirically exhibits a desirable physical change that will enable a pellet's physical transition without necessarily correlating to the predicted melting point ranges.

The pellet material composition thus comprises at least one organic arene compound, such as dibenzosuberenone, which generally has a melting point or melting point range near the pre-selected or desired transition temperature, yet also exhibits minimal loss of dielectric properties at high temperatures exceeding the transition temperature $T_f$.

The thermal cutoff device including such a pellet material composition can optionally have a seal disposed in a portion of at least one opening of the housing that substantially seals the housing up to the transition temperature of the pellet material composition. As discussed above, the thermal cutoff device also comprises a current interruption assembly that is at least partially disposed within the housing. The current interruption assembly establishes electrical continuity in a first operating condition of the thermal cutoff device, which corresponds to an operating temperature of less than the transition temperature ($T_f$) of the pellet material composition and that discontinues electrical continuity when the operating temperature exceeds the transition temperature ($T_f$).

In certain aspects, the compositions selected for use in the pellet material composition exhibit long-term stability. By way of example, compositions are optionally selected to possess temperature or thermal stability, in other words, chemical compounds that show high levels of decomposition or volatility behavior within about 10° C., optionally within about 20° C., optionally within about 30° C., optionally within about 40° C., optionally within about 50° C., optionally within about 60° C., optionally within about 75° C., and in certain aspects, optionally within about 100° C. of the transition temperature $T_f$ or melting point of the organic compound may be rejected as viable candidates. The inclusion of the dibenzosuberenone enhances the long-term stability of the pellet composition and minimizes substantial dielectric loss.

In certain alternative aspects, the present disclosure provides methods for enhancing thermal stability of a pellet composition for use in a thermally actuated, current cutoff device. Such a method may comprise forming a pellet composition comprising dibenzosuberenone, where the pellet composition maintains its structural rigidity up to a transition temperature ($T_f$). The improved pellet composition exhibits the same $T_f$ as a comparative pellet composition, but has improved aging performance.

For example, in certain variations, the improved aging performance may be determined by conducting an aging test at 81° C. on a thermal cutoff device incorporating the inventive pellet composition. In certain aspects, TCO devices incorporating conventional pellet compositions comprising p-dibromobenzene start to open and thus fail (28% of the TCO devices tested) at 34 weeks and 40% of the TCO devices tested having pellets comprising p-dibromobenzene open at 42 weeks. However, the pellet compositions comprising dibenzosuberenone tested under the same conditions do not open or fail until after over 2 years of exposure to 81° C.

Thus, in certain aspects, a thermal cutoff device incorporating a pellet composition comprising dibenzosuberenone has an aging performance of 0% of the tested devices opening (and thus failing) after greater than or equal to about 10 months after exposure to 81° C., optionally 0% of the tested devices opening after greater than or equal to about 12 months after exposure to 81° C., optionally 0% of the tested devices opening after greater than or equal to about 16 months after exposure to 81° C., optionally 0% of the tested devices opening after greater than or equal to about 18 months after exposure to 81° C., and optionally 0% of the tested devices opening after greater than or equal to about 24 months after exposure to 81° ° C.

Thus, in certain aspects, a thermal cutoff device comprising a pellet composition according to the present disclosure exhibits an improved aging performance by avoiding failure (and opening) for greater than or equal to about 12 months after sustained exposure to 81° C., optionally by avoiding failure for greater than or equal to about 24 months after sustained exposure to 81° ° C.

In certain aspects, the inventive pellet compositions comprising dibenzosuberenone may exhibit a slower rate of aging at a temperature below the $T_f$ of at least 2% as compared to a comparative conventional pellet composition comprising p-dibromobenzene, optionally the rate of aging may be slowed by at least 3% or more; optionally at least 4% or more; and in certain aspects 5% or more. The rate of aging may be tested at various different temperatures below the transition temperature $T_f$, as are well known in the art and described further below in the examples. Typical rates of aging can be tested at a temperature of $T_f$−40°, $T_f$−25°, $T_f$−20°, $T_f$−15°, $T_f$−10°, or $T_f$−6°, by way of non-limiting example. The slowed rate of aging and thermal stability conferred by certain aspects of the present teachings is particularly noticeable at higher temperatures near the $T_f$, such as at $T_f$−15° and $T_f$−10°.

As discussed above, some conventional TCO devices are not able to fulfill certain performance criteria, particularly long-term stability and robustness during an overshoot operating period (upon exposure to high-temperatures, after activation and current interruption in a safety device application). Furthermore, in both conventional TCO devices and HTTCO devices, suitable pellet compositions are those that exhibit dielectric properties after a temperature exceeds the pellet composition's transition temperature $T_f$, meaning that the pellet composition is capable of maintaining a 500 volt (2 times rated voltage of about 250 VAC) 60 Hz sinusoidal potential (VAC) between two electrodes at least about 50° C. above the transition temperature for at least one minute without conducting greater than 250 mA. However, the pellet compositions used in certain existing TCO devices and/or HTTCO devices are rated for temperatures at which the underlying composition only retains its dielectric properties in a range of about 160° C. of its transition temperature (where $T_f < T_{cap} \leq (T_f + 160°\ C.)$). In other words, both conventional TCO devices and HTTCO devices have not sufficiently fulfilled performance criteria for certain applications, where prolonged current and/or high-temperatures may continue to be experienced even after activation of the safety device. In certain embodiments, the improved pellet compositions are capable of maintaining a 500 volt, 60 Hz sinusoidal potential (VAC) at least 160° C. above the transition temperature for at least one minute without conducting greater than 250 mA (reflected by the $T_{cap}$ being at least 160° C. above the $T_f$).

An illustrative test to demonstrate performance of a pellet composition, for example to assess dielectric properties, includes forming the composition into a pellet, placing the pellet in a kiln or oven, and subjecting the pellet to a standard dielectric test and/or a standard insulation resistance test, while raising temperatures intermittently. While the pellet, if utilized in a TCO device, ideally meets or exceeds the aforementioned illustrative test protocol, it should be understood by those skilled in the art that the compositions are contemplated as being useful for both low and high voltage applications. Further, in certain aspects, the pellet compositions with substantial dielectric properties meet or exceed the Underwriters' Laboratory test UL1020 or IEC/EN 60691 standards, which are respectively incorporated herein by reference, see in particular Clauses 10.3 and 10.4 in Table 1, below. Notably, the $T_{max}$ test protocol is also described in Clause 11.3 contained in Table 1. In other aspects, a test to assess dielectric performance can include forming the composition into a pellet, placing the pellet (in a TCO device) in a kiln or oven, where the kiln or oven has a pre-selected temperature above $T_f$, and subjecting the pellet to an increasing AC voltage until breakdown.

In certain embodiments, TCO devices comprised of the thermally stable pellet compositions have substantial dielectric properties and meet one or more of such standards at the pre-selected temperature rating for the device. While the performance criteria is fully outlined in each of these standards, salient aspects of performance tests that demonstrate conformance to the IEC 60691, Third Edition standard are summarized in Table 1.

TABLE 1

| | | |
|---|---|---|
| I | Clause 10.6 Current Interrupt Test: | |
| A | | Sample is placed in a kiln at rated functioning temperature minus 10° C. for three minutes. |
| B | | Sample is tested at 110% of rated voltage and 150% of rated current until sample interrupts the test current. |
| II | Clause 10.7 Transient Overload (pulse) Test: | |
| A | | Samples are place in the current path of D.C. current pulses, with an amplitude of 15 times rated current for a duration of 3 ms with 10 s intervals are applied for 100 cycles. |
| III | Clause 11.2 Temperature Check ($T_f$): | |
| A | | Samples are placed in an oven at rated functioning temperature minus 10° C. until stable, the temperature is then increased steadily at 0.5° C./minute until all samples are opened, recording the temperature of opening to pass +0/−5° C. |
| IV | Clause 11.3 Maximum Temperature ($T_{max}$): | |
| A | | Samples are placed in a kiln at a specified temperature for 10 minutes, with the samples maintained at $T_{max}$ a dielectric test at a predetermined voltage (e.g., 500 Vac) with no breakdown, and an insulation resistance test at a predetermined voltage (e.g., 500 Vdc with a minimum of 0.2 MΩ). |
| V | Clause 11.4 Aging: | |
| A | | Samples are placed in a kiln at a predetermined temperature for three weeks. At the conclusion of this test, at least 50% of samples shall not have functioned. |
| B | | Samples are then placed in a kiln at rated functioning temperature minus 15° C. for three weeks. At the conclusion of this test, at least 50% of samples shall not have functioned. |
| C | | Samples are then placed in a kiln at rated functioning temperature minus 10° C. for two weeks. |
| D | | Samples are then placed in a kiln at rated functioning temperature minus 5° C. for one week. |
| E | | Samples are then placed in a kiln at rated functioning temperature minus 3° C. for one week. |
| F | | Samples are then placed in a kiln at rated functioning temperature plus 3° C. for 24 hours. |
| G | | This test is considered successful if all samples have functioned at the conclusion of step F. |
| VI | Clause 10.3/10.4 Room Temperature Dielectric and Insulation Resistance: | |
| A | | All test samples must complete and comply with a dielectric test at 500 Vac with no breakdown, and an insulation resistance test at 500 Vdc with a minimum of 0.2 MΩ |

Example 1

In accordance with various aspects of the present disclosure, a pellet material composition for use in a TCO exhibiting substantial dielectric properties (having maximum temperature rating $T_{max}$ of greater than or equal to about 300° C.), improved aging performance, enhanced pelletizing ability and therefore higher production yields, and higher crush strength due to the inclusion of dibenzosuberenone is formed as follows. A pellet is formed by mixing about 25.2 mg (98.4%±0.5% of the pellet) of dibenzosuberenone (commercially available at 98% purity); about 0.4 mg of additives of colorants, binders, and or release agents (1.6%±0.5% of the pellet). The mixture is then screened and folded by hand, followed by processing on a standard powder compaction in a pelletizing process.

The pelletizing process includes feeding powder through a gated powder flow control system and spread evenly over a rotary die table. The powder fills the dies (for the pellets) and punches/presses the powder in the dies under approximately 1 ton to 4 tons pressure to form a compacted powder pellet. Here, a density of the compacted pellet is 29 pellets per gram to 50 pellets per gram. Certain sample pellets are tested for structural and mechanical integrity, including measuring crush strength of the pellets.

Next, the pellet is introduced into TCO Device 1 (a Therm-O-Disc X6 TCO device). The pellet is thus placed into a high-conductivity metal, closed-end cylinder with an inner diameter approximately the outer perimeter of the TCO pellet. The closed end of the cylinder is staked shut with an axial conductive metal lead protruding out of the cylinder. Other components are loaded atop the pellet in a stacked fashion depending on the end-use requirements of the TCO. A sub-assembly comprised of a non-conductive ceramic bushing with an axial bore hole and a conductive metal lead that has been inserted in the open bore and mechanically restrained into a permanent one-piece assembly by deformation of the metal lead is inserted into the open end of the TCO cylinder. The stacked components are compressed into the cylinder by the ceramic, isolated lead assembly and the rim of the open end of the cylinder is mechanically rolled over the ceramic bushing to permanently enclose the internal components in the TCO cylinder. An epoxy-type sealant is applied to the rolled over open end of the cylinder, the ceramic bushing and the base of the isolated lead.

The assembled TCO is then cured for about 9 hours at 48° C.-60° C. under 0% RH to 85%. Next, the operating temperature of the TCO is raised to a final or transition temperature, here the $T_f$ is 89.3° C. The temperature is held constant for ten minutes while the TCO is exposed to a dielectric withstand test and then an insulation test, as well as aging data. The salient features of each test are summarized in Table 1, above. Also as mentioned above, the dielectric withstand test and insulation resistance test meet the requirements of IEC 60691 $3^{RD}$ Ed, Clause 10.3 and Amendment 1 and IEC 60691 $3^{RD}$ Ed, Clause 10.4 and Amendment 1, respectively. Ideally, all test samples complete and comply with a dielectric test at 500 Vac with no breakdown, and an insulation resistance test at 500 Vdc with a minimum of 0.2 MΩ. Further, the TCO ideally should not exhibit any type of damage. For purposes of the dielectric withstand test, "breakdown" means a sudden and complete drop in test voltage or the inability to maintain the specified test voltage.

Conventional seals, like an epoxy seal, generally break down or degrade so that the seal is damaged/ineffective at temperatures of about 380° C. and above. With the pellet composition of this Example, the underlying epoxy seal of the TCO typically becomes damaged and/or ineffective after reaching a temperature of between about 380° and 410°, thereby rendering further improvements to $T_{max}$ moot. However, most $T_{max}$ ratings for comparative pellets are generally commercially limited to an overshoot temperature range of only about 20-100° C. above the $T_f$ prior to potential loss of dielectric properties.

Therefore, it is surprisingly found that the use of dibenzosuberenone as the organic compound of the TCO composition provided a transition temperature $T_f$ of about 89° C. and an increased maximum temperature rating ($T_{max}$) of at least about 300° C. to about 430° C. (improving an overshoot temperature range at least 210° C. over the transition temperature). For safety reasons, a margin of about 30° C. is subtracted from that maximum dielectric capability temperature ($T_{cap}$) of about 130° C. to provide a maximum temperature rating ($T_{max}$). While not limiting the present teachings to any particular theory, it is believed that due to the lower ionization potential of dibenzosuberenone, namely the amount of ions is restricted that would otherwise be generated from certain organic substituents through which current may pass, thereby limiting the chemical available for voltage breakdown. Furthermore, the aging performance was significantly enhanced, as shown in Table 2 (showing a comparison of a conventional pellet composition comprising p-dibromobenzene versus an inventive pellet composition comprising dibenzosuberenone). Lastly, the crush strength of the pellet is significantly improved as compared to the comparative conventional component.

Comparative Example 1

A conventional TCO pellet comprises an organic compound of p-dibromobenzene that is rated for a transition temperature $T_f$ of about 88° C. The pellet is processed in the same manner described above in the context of Example 1 and is incorporated into the same type of TCO device (Device 1, a Therm-O-Disc X6 TCO device). The pellet is tested for a maximum dielectric capability temperature ($T_{cap}$) for a 500V test of 160° C. and is also tested for insulation resistance test at 500 Vdc with a minimum of 0.2 MΩ. Such a conventional TCO has a 160° C. $T_{max}$ rating.

Example 2

In accordance with other aspects of the present disclosure, a pellet material composition for use in a TCO exhibits substantial dielectric properties (having maximum temperature rating $T_{max}$ of greater than or equal to about 340° C.), improved aging performance, pelletizing ability and therefore higher production yields, and crush strength due to the inclusion of dibenzosuberenone.

A pellet is formed with the same ingredients and by the same process as described above in the context of Example 1 and thus has the same $T_f$. The pellet is incorporated into Device 2 in the same manner that the pellet was incorporated into Device 1 in Example 1. Device 2 is a Therm-O-Disc X5 TCO device. The test samples complete and comply with a dielectric test at 554 Vac with no breakdown, and an insulation resistance test at 554 Vdc with a minimum of 0.2 MΩ. Test results are shown in Table 2.

Comparative Example 2

A second conventional TCO pellet is the same as that in Comparative Example 1 and comprises p-dibromobenzene. The pellet is processed in the same manner described above in the context of Example 2 and is incorporated into the same type of TCO device (Device 2, a Therm-O-Disc X5 TCO device having a floating contact that cuts off at a higher current indicated by the Current Interrupt test). The pellet is tested for a maximum dielectric capability temperature ($T_{cap}$) for a 554V test of 160° C. and is also tested for insulation resistance test at 554 Vdc with a minimum of 0.2 MΩ. Such a conventional TCO has a 245° C. $T_{max}$ rating.

TABLE 2

| Capability/ Performance | Inventive Pellet (Dibenzosuberenone) | Conventional Pellet (p-dibromobenzene) |
|---|---|---|
| Aging at 81° C. | Does not open after 2 years | 28% start to open at week 34, 40% open at week 42 |
| Average $T_f$ | 89.3° C., near to medium | 87.7° C., near to lower limit |
| $T_{max}$ of Device 1 | Example 1 passed 300 C./500 V | Comparative Example 1 passed 160 C./500 V |
| $T_{max}$ of Device 2 | Example 2 passed 430 C./554 V | Comparative Example 2 passed 245 C./554 V |
| Current Interrupt (CI) of Device 1 at 26A, pass/total | 40/40 (100%) | 18/20 (90%) |
| CI of Device 2 at 34A, pass/total | 59/60 (98.3%) | 19/20 (95%) |
| Pellet process | good pelletizing process and good crush strength (average of ≥19 lbs.) | 100% needed re-work and 5-10% of pellets are discarded/scrap because of crush strength (average of about 12.7 lbs.) |

As can be seen in Table 2, inventive pellet compositions of Examples 1 and 2 (comprising dibenzosuberenone) tested in either Devices 1 or 2 have nearly the same $T_f$ as a conventional pellet composition of Comparative Examples 1 and 2 (comprising p-dibromobenzene). However, the $T_{max}$ significantly improved to 300° C. for Device 1 and to 430° C. for Device 2, as compared to the conventional pellet (160° C. for Device 1 and only 245° C. for Device 2). The dibenzosuberenone experiences significantly less ionization at high temperatures than p-dibromobenzene, because it lacks ionizable groups. For example, dibenzosuberenone has an ionization potential of greater than or equal to about 0.1 mg/kg to less than or equal to about 1 mg/kg, when ionization levels via an ion chromatography tester, by way of example. The ion content can be tested with an ion chromatography tester Thermo Scientific ICS-1500 sold by Dionex, by way of example.

Aging performance is improved for Examples 1 and 2. Comparative Examples 1 and 2 comprising p-dibromobenzene start to open (28%) at 34 weeks and 40% of the test pellet compositions of pellets comprising p-dibromobenzene open at 42 weeks when exposed to constant heat at 81° C. However, Examples 1 and 2 that comprise dibenzosuberenone are tested under the same conditions and do not open until after in excess of 2 years of exposure to 81° C. The pelletizing process for Comparative Examples 1 and 2 required 100% re-work, while 5-10% of pellets on average had to be discarded as scrap, because of inadequate crush strength. Through analysis on the normal nonconforming products, it has been found that the p-dibromobenzene has difficulty flowing into the die and then being pelletized. Flowability of the powders can be tested by using a funnel. First, a predetermined weight of the powder is measured, the powder is placed into the funnel, and then time that the powder flows from the funnel is recorded. The p-dibromobenzene powder flow times are significantly longer than dibenzosuberenone powder.

The average crush strength was only 12.7 lbs. for Comparative Examples 1 and 2, while Examples 1 and 2 had an average 19 lbs. of crush strength. Examples 1 and 2 had improved flowability of the powder and thus were more readily pelletized to provide higher crush strengths, thus significantly improving the pelletizing process yields. Furthermore, it has been observed that lubricant (e.g., calcium stearate) used during the pelletizing can be reduced or eliminated.

In certain aspects, the present disclosure contemplates methods of forming the pellet composition. Such a method may first include admixing an organic compound comprising the dibenzosuberenone and one or more additive components. Any of the components discussed above are contemplated here in these methods. The mixing may include homogenously mixing the components. The organic compound and the one or more additive components may be melted together (e.g., by being heated above the melting point of the various components) for the admixing process to form an admixture. The admixture is then cooled. Next, the admixture may be ground to form a powder. Then, the admixture is pelletized by introducing or flowing the powder into a pelletizer machine. The powder is then introduced into a die having a cavity in a shape that will form the pellet. The powder is compressed by applied pressure in the die (e.g., by a hydraulic press in the pelletizer machine) to form a solid pellet with an increased density.

The pellet material compositions can be manufactured into any commercially available form suitable for use inside a housing of a TCO, including granules, pellets, spheres and any geometric shape known to those in the art. See for example, the exemplary cylindrical-shaped pellet 25 shown in FIG. 3. Thus, the mixture may be processed into compacted shapes, such as pellets or grains, by application of pressure in a die or mold, by way of example. The structural integrity of pellets is desirably sufficient to withstand compressive forces of the TCO device, for example to withstand the applied force and bias to the TCO springs and encasement in a TCO assembly. By way of example, certain TCOs are capable of withstanding extended exposure to operating temperatures up to about 5° C. below the threshold or actuation temperature without breaking the electrical continuity of the circuit.

As noted above, in certain aspects, the admixture may omit a lubricant or reduce the amount of lubricant used to minimal levels (e.g., calcium stearate) due to the superior flowability of the powder formed by inclusion of dibenzosuberenone in the admixture during processing. Further, the solid pellet formed by such a process has an improved crush strength, for example, of greater than or equal to about 15 lbs for a predetermined and uniform surface area, optionally greater than or equal to about 16 lbs, optionally greater than or equal to about 17 lbs, optionally greater than or equal to about 18 lbs, and in certain variations, optionally greater than or equal to about 19 lbs.

Furthermore, as noted above, a yield during such a process of pelletizing and production is increased when using a material comprising dibenzosuberenone. For example, a yield of such a process, namely the final yield reflecting the proportion of defect-free pellets produced during the production process, may be greater than or equal to about 90%, optionally greater than or equal to about 91%, optionally greater than or equal to about 92%, optionally greater than or equal to about 93%, optionally greater than or equal to about 94%, optionally greater than or equal to about 95%, optionally greater than or equal to about 96%, optionally greater than or equal to about 97%, optionally greater than or equal to about 98%, optionally greater than or equal to about 99%, and in certain variations, 100%.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pellet composition in a thermally-actuated, current cutoff device, the pellet composition comprising dibenzosuberenone is in a solid phase and maintains its structural rigidity up to a transition temperature ($T_f$) of greater than or equal to about 80° C. in the thermally-actuated, current cutoff device.

2. The pellet composition of claim 1, wherein the pellet composition comprises dibenzosuberenone at greater than or equal to about 93% by weight of a total pellet composition.

3. The pellet composition of claim 1, wherein the pellet composition has a maximum dielectric capability temperature ($T_{cap}$) above which the pellet composition loses substantial dielectric properties and conducts current, wherein the $T_{cap}$ is about 160° C. or greater than the $T_f$.

4. The pellet composition of claim 3, wherein the $T_f$ is greater than or equal to about 80° C. and less than or equal to about 90° C. and the $T_{cap}$ is greater than or equal to about 200° C. above the $T_f$.

5. The pellet composition of claim 3, wherein the $T_{cap}$ is greater than or equal to about 300° C. above the $T_f$.

6. The pellet composition of claim 1, further comprising one or more additive components selected from the group consisting of: binders, lubricants, press-aids, pigments, and combinations thereof, wherein the one or more additive components are cumulatively present at less than or equal to about 10% by weight.

7. The pellet composition of claim 6, wherein the one or more additive components are cumulatively present at less than or equal to about 7% by weight of a total pellet composition and the dibenzosuberenone is present at greater than or equal to about 93% by weight of the total pellet composition.

8. The pellet composition of claim 1, wherein the pellet composition comprises dibenzosuberenone at greater than or equal to about 98% by weight of a total pellet composition.

9. The pellet composition of claim 1, wherein the pellet composition has a crush strength of greater than or equal to about 15 lbs.

10. A method for forming a thermally stable pellet composition in a thermally-actuated, current cutoff device, the method comprising:

admixing dibenzosuberenone and one or more additive components selected from the group consisting of: binders, lubricants, press-aids, pigments, and combinations thereof to form an admixture;

melting and then cooling the admixture;

grinding the admixture to form a powder; and disposing the powder in a die and applying pressure to the powder to form a compacted solid pellet that maintains its structural rigidity up to a transition temperature ($T_f$) of greater than or equal to about 80° C.

11. The method of claim 10, wherein the method is repeated to form a plurality of compacted solid pellets and a final yield of the method is greater than or equal to about 95%.

12. The method of claim 10, wherein the compacted solid pellet has a crush strength of greater than or equal to about 15 lbs.

13. The method of claim 10, wherein the compacted solid pellet comprises dibenzosuberenone at greater than or equal to about 93% by weight and the one or more additive components are cumulatively present at less than or equal to about 7% by weight of the compacted solid pellet.

14. The method of claim 10, wherein a density of the compacted solid pellet is 29 pellets per gram to 50 pellets per gram.

15. A thermally-actuated, current cutoff pellet in a thermally-actuated, current cutoff device, the pellet comprising:

dibenzosuberenone; and one or more additive components, wherein the pellet is a compacted solid that maintains its structural rigidity up to a transition temperature ($T_f$) of greater than or equal to about 80° C. in the thermally-actuated, current cutoff device.

16. The thermally-actuated, current cutoff pellet of claim 15, wherein the pellet has a maximum dielectric capability temperature ($T_{cap}$) above which the pellet loses substantial dielectric properties and conducts current, wherein the $T_{cap}$ is about 160° C. or greater than the $T_f$.

17. The thermally-actuated, current cutoff pellet of claim 16, wherein the $T_f$ is greater than or equal to about 80° C. and less than or equal to about 90° C. and the $T_{cap}$ is greater than or equal to about 200° C. above the $T_f$.

18. The thermally-actuated, current cutoff pellet of claim 15, wherein the one or more additive components is selected from the group consisting of: binders, lubricants, press-aids, pigments, and combinations thereof, wherein the one or more additive components are cumulatively present at less than or equal to about 10% by weight of the pellet.

19. The thermally-actuated, current cutoff pellet of claim 15, wherein the one or more additive components are cumulatively present at less than or equal to about 7% by weight of the pellet and the dibenzosuberenone is present at greater than or equal to about 93% by weight of the pellet.

* * * * *